US007494404B2

(12) United States Patent
Sung

(10) Patent No.: US 7,494,404 B2
(45) Date of Patent: Feb. 24, 2009

(54) TOOLS FOR POLISHING AND ASSOCIATED METHODS

(76) Inventor: Chien-Min Sung, 4, Lane 32, Chung-Cheng Road, Tansui, Taipei County 251 (TW)

( * ) Notice: Subject to any disclaimer, the term of this patent is extended or adjusted under 35 U.S.C. 154(b) by 0 days.

(21) Appl. No.: 11/825,518

(22) Filed: Jul. 6, 2007

(65) Prior Publication Data

US 2007/0289223 A1 Dec. 20, 2007

Related U.S. Application Data

(63) Continuation-in-part of application No. 11/543,761, filed on Oct. 4, 2006, now Pat. No. 7,285,039, and a continuation-in-part of application No. 11/706,132, filed on Feb. 12, 2007, now abandoned, application No. 11/825,518, which is a continuation-in-part of application No. 11/357,712, filed on Feb. 17, 2006, now Pat. No. 7,241,206.

(51) Int. Cl.
*B24D 11/00* (2006.01)

(52) U.S. Cl. ..... 451/527; 451/539

(58) Field of Classification Search ..... 451/56, 451/57, 59, 526–539, 540–558, 443; 51/293, 51/295, 307, 309
See application file for complete search history.

(56) References Cited

U.S. PATENT DOCUMENTS

| | | | | |
|---|---|---|---|---|
| 4,712,334 | A | 12/1987 | Ikezaki et al. | |
| 5,645,472 | A | 7/1997 | Nagahashi et al. | |
| 5,879,220 | A | 3/1999 | Hasegawa et al. | |
| 6,022,268 | A | 2/2000 | Roberts et al. | |
| 6,027,659 | A | 2/2000 | Billett | |
| 6,213,856 | B1 | 4/2001 | Cho et al. | |
| 6,354,907 | B1 | 3/2002 | Satoh et al. | |
| 6,582,283 | B2 * | 6/2003 | James et al. | 451/41 |
| 6,632,127 | B1 | 10/2003 | Zimmer et al. | |
| 6,699,106 | B2 | 3/2004 | Myoung et al. | |
| 6,736,709 | B1 | 5/2004 | James et al. | |
| 6,755,719 | B2 | 6/2004 | Yoshida et al. | |
| 6,769,969 | B1 | 8/2004 | Duescher | |
| 6,893,328 | B2 | 5/2005 | So | |
| 6,899,592 | B1 | 5/2005 | Kojima et al. | |
| 6,899,602 | B2 | 5/2005 | Fawcett et al. | |
| 6,918,820 | B2 | 7/2005 | Smith et al. | |
| 6,932,677 | B2 * | 8/2005 | Nakano et al. | 451/41 |

(Continued)

OTHER PUBLICATIONS

U.S. Appl. No. 11/881,403, filed Jul. 25, 2007, Sung, Chien-Min.

(Continued)

*Primary Examiner*—Dung Van Nguyen
(74) *Attorney, Agent, or Firm*—Thorpe North & Western LLP

(57) ABSTRACT

Polishing tools and associated methods are disclosed. In one aspect, a tool for polishing a work piece is provided. Such a tool may include a solid substrate with a greater than 10 wt % graphite having a high degree of graphitization. The solid substrate may have a working surface which has asperities having a tip-to-tip RA value of less than or equal to about 10 μm, and the working surface may have a surface roughness RA value of less than or equal to about 50 μm. A method for making such a tool and a method for polishing a work piece are also presented.

17 Claims, 2 Drawing Sheets

U.S. PATENT DOCUMENTS

| | | | | |
|---|---|---|---|---|
| 7,186,164 | B2 * | 3/2007 | Manens | 451/5 |
| 7,241,206 | B1 | 7/2007 | Sung | |
| 7,285,039 | B1 * | 10/2007 | Sung | 451/56 |
| 2003/0216111 | A1 | 11/2003 | Ohno et al. | |
| 2004/0023610 | A1 * | 2/2004 | Hu et al. | 451/526 |
| 2004/0166780 | A1 | 8/2004 | Lawing | |
| 2005/0020188 | A1 | 1/2005 | Saito et al. | |
| 2007/0060026 | A1 | 3/2007 | Sung | |

OTHER PUBLICATIONS

U.S. Appl. No. 11/706,132, filed Feb. 12, 2007, Sung, Chien-Min.
U.S. Appl. No. 11/543,761, filed Oct. 4, 2006, Sung, Chien-Min.

* cited by examiner

TOOLS FOR POLISHING AND ASSOCIATED METHODS

RELATED APPLICATIONS

This application is a continuation-in-part of U.S. patent application Ser. No. 11/543,761 filed Oct. 4, 2006, now U.S. Pat. No. 7,285,039 and of U.S. patent application Ser. No. 11/706,132 filed Feb. 12, 2007, now abandoned each of which is a continuation-in-part of U.S. patent application Ser. No. 11/357,712, filed Feb. 17, 2006, now U.S. Pat. No. 7,241,206 all of which are incorporated herein by reference in their entirety.

FIELD OF THE INVENTION

The present invention relates generally to polishing tools and associated methods. Accordingly, the present invention involves the chemical and material science fields.

BACKGROUND OF THE INVENTION

Many industries utilize various types of mechanical polishing processes for polishing work pieces. For example, the computer manufacturing industry relies heavily on chemical mechanical polishing (CMP) processes for polishing wafers of ceramics, silicon, glass, quartz, and metals. Such polishing processes generally entail applying the wafer against a rotating pad made from a durable organic substance such as polyurethane. A chemical slurry is utilized that contains a chemical capable of breaking down the wafer substance and an amount of abrasive particles which act to physically erode the wafer surface. The slurry is continually added to the rotating CMP pad, and the dual chemical and mechanical forces exerted on the wafer cause it to be polished in a desired manner.

Of particular importance to the quality of polishing achieved with this method of polishing is the distribution of the abrasive particles throughout the pad. The top of the pad holds the particles by means of fibers or small pores, which provide a friction force sufficient to prevent the particles from being thrown off of the pad due to the centrifugal force exerted by the pad's spinning motion. Therefore, it is important to keep the top of the pad as flexible as possible, to keep the fibers as erect as possible, and to assure that there is an abundance of open pores available to receive newly applied abrasive particles.

One problem that arises with regard to maintaining the pad surface, however, is an accumulation of polishing debris coming from the work piece, the abrasive slurry, and the pad dresser. This accumulation causes a "glazing" or hardening of the top of the pad, mats the fibers down, and thus makes the pad surface less able to hold the abrasive particles of the slurry. These effects significantly decrease the pad's overall polishing performance. Further, with many pads, the pores used to hold the slurry, become clogged, and the overall asperity of the pad's polishing surface becomes depressed and matted. A CMP pad dresser can be used to revive the pad surface by "combing" or "cutting" it. This process is known as "dressing" or "conditioning" the CMP pad. Many types of devices and processes have been used for this purpose. One such device is a disk with a plurality of superhard crystalline particles such as diamond particles attached to a metal-matrix surface.

As semiconductor technology continues toward size reduction to the nano-scale, however, current CMP polishing techniques are proving to be inadequate. With such a reduction in scale, materials utilized to construct circuit elements have become more delicate, both in size and materials. The CMP industry has been required to respond by providing polishing materials and techniques that accommodate these advances. For example, lower CMP polishing pressures, smaller size abrasive particles in the slurry, and polishing pads of a size and nature that do not over polish or damage the wafer must be used. Furthermore, pad dressers that cut asperities in the pad which can accommodate the smaller abrasive particles, and that do not overdress the pad must also be used.

There are a number of problems associated with modifying current CMP processes to accommodate such delicate polishing. With regard to the CMP pad dresser, the superabrasive particles must be significantly smaller than those typically used in currently know dressing operations. Generally speaking, the superabrasive particles are so small that a traditional metal matrix is often unsuitable for holding and retaining them. Further, the smaller size of the superabrasive particles requires that particle tip height be precisely leveled in order to uniformly dress the pad. Traditional CMP pad dressers can have particle tip height variations of more than 50 μm without compromising dressing performance. However, such a variation would render a dresser useless if it were required to dress a CMP pad and achieve polishing of extremely small and delicate circuit elements. In this case, asperities in the dressed pad would have height variations on the same order as the dresser. The highest asperities exert the highest pressure, and would thus scratch and damage the wafer.

In addition to drastic height variations relative to the delicacy of the polishing operation, damage to the wafer can also occur due to the abrasive particles themselves. Sizing of these particles can be problematic, particularly with the smaller sizes required for more delicate polishing operations. Larger abrasive particles that tend to cause surface damage to the wafer are thus difficult to eliminate from the slurry.

Some polishing processes have found it beneficial to add an electrical element to the polishing process which results in electrochemical polishing in conjunction with the mechanical polishing. Such a process is known as electrochemical mechanical polishing (ECMP). In this type of system, conductive materials are removed from a surface to be polished via electrochemical dissolution coupled with mechanical polishing. Because of the electrical element, this method requires less mechanical or forced abrasion. ECMP, therefore, can be used in polishing surfaces that are more susceptible to deforming, breaking and cracking if left to mechanical and/or chemical means alone. Additionally, ECMP can allow for a very fine polish—particularly with such surfaces as copper circuitry.

As a result, polishing tools that are suitable for delicate polishing applications such as those that have arisen with continual reductions in semiconductor size are being sought.

SUMMARY OF THE INVENTION

Accordingly, the present invention provides conductive polishing tools and methods that are, without limitation, suitable for delicate polishing applications as recited above. In one aspect, a tool for polishing a work piece is provided. Such a tool may include a solid substrate. The solid substrate may have greater than 10 wt % graphite having a high degree of graphitization. The solid substrate may also have a working surface which includes asperities having a tip-to-tip RA value of less than or equal to about 10 μm. The working surface may also have a surface roughness RA value of less than or equal to about 50 μm. In one aspect, the degree of graphitization of the graphite can be greater than 0.90. The graphite can have a metal dispersed therein, or can include interclating atoms. The substrate can further include a non-graphite-having-a-high-degree-of-graphitization carbon allotrope.

A method for making an electroprocessing polishing tool that is configured to carry an electrical bias is also presented. Such a method may include truing a working surface of a solid substrate to a surface roughness RA value of less than or equal to about 50 μm. The solid substrate may include greater than 10 wt % graphite having a high degree of graphitization. The method may further include forming asperities on the working surface. The asperities may have a tip-to-tip RA value of less than or equal to about 10 μm. The conductive material may be a carbon allotrope, such as graphite or carbon nanotubes. In one aspect, the working surface of the solid substrate may be pre-trued.

In another aspect of the present invention, a method of polishing a work piece is provided. Such a method may include providing a polishing tool including a solid substrate with at least 10 wt % graphite having a high degree of graphitization sufficient to allow the substrate to carry an electrical bias. The solid substrate may have asperities on a working surface, where the asperities have a tip-to-tip RA value of less than or equal to about 10 μm, and the working surface has a surface roughness RA value of less than or equal to about 50 μm. The method may also include coupling the working surface to a power supply, and establishing an electrically-conductive path from the working surface to an interface surface of the work piece. The method may further include contacting the tips of the asperities against an interface surface of the work piece and moving the tips of the asperities in a direction substantially parallel to the interface surface of the work piece such that the interface surface is polished. The method may additionally include electrochemically removing a portion of the interface surface of the work piece. In an aspect of the present invention, more than one step may be performed at the same time, for instance, the mechanical and the electrical polishing. In another aspect, a liquid solution may be added to the solid substrate. And in a further aspect, an electrically-conductive path may be established through the liquid solution. In an aspect, the power supply may be continuous or discontinuous.

There has thus been outlined, rather broadly, various features of the invention so that the detailed description thereof that follows may be better understood, and so that the present contribution to the art may be better appreciated. Other features of the present invention will become clearer from the following detailed description of the invention, taken with the accompanying claims, or may be learned by the practice of the invention.

DETAILED DESCRIPTION OF THE INVENTION

Definitions

In describing and claiming the present invention, the following terminology will be used in accordance with the definitions set forth below.

The singular forms "a," "an," and, "the" include plural referents unless the context clearly dictates otherwise. Thus, for example, reference to "a particle" includes reference to one or more of such particles, and reference to "the metal" includes reference to one or more of such metals.

As used herein, "asperity" refers to a protrusion that has been purposefully formed on a surface of a substrate, the protrusion having a well-defined tip at the apex.

Figure 3:
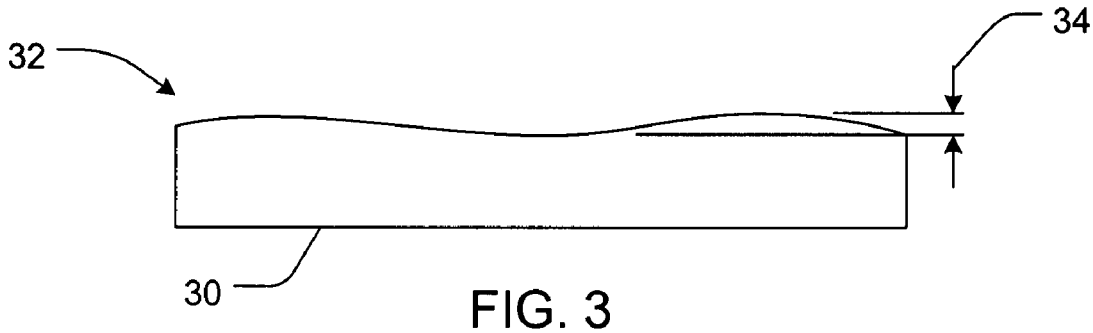
FIG. 3 is a cross-sectional view of a solid substrate in accordance with another embodiment of the present invention.

As used herein, "surface roughness RA" refers to a measure of the roughness of a surface as determined by the difference in height between the highest peak on the surface and the lowest valley on the surface. A depiction of surface roughness RA is shown in FIG. 3 at 34.

Figure 4:
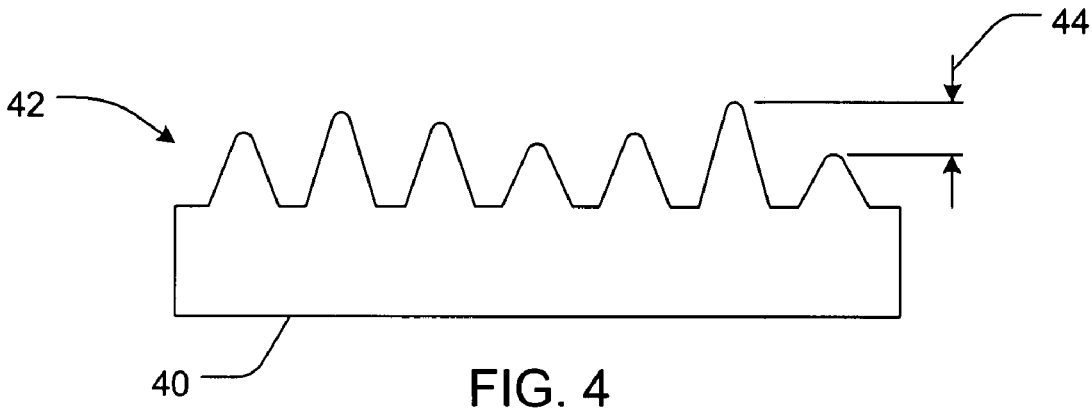
FIG. 4 is a cross-sectional view of a polishing tool in accordance with yet another embodiment of the present invention.

As used herein, "tip-to-tip RA" refers to a measure of the difference in height between the highest asperity tip and the lowest asperity tip. A depiction of tip-to-tip RA is shown in FIG. 4 at 44.

As used herein, "metallic" refers to a metal, or an alloy of two or more metals. A wide variety of metallic materials is known to those skilled in the art, such as aluminum, copper, chromium, iron, steel, stainless steel, titanium, tungsten, zinc, zirconium, molybdenum, etc., including alloys and compounds thereof.

As used herein, "Babbitt alloy" refers to a group of soft metal alloys that are well known in the art. Common non-limiting types include lead based, lead-silver based, tin based, cadmium based, arsenic based, and various combinations thereof.

As used herein, the term "carbon allotrope" refers to substances composed of carbon which have distinct physical forms (i.e. crystalline structures). Examples of carbon allotropes include graphite, amorphous carbon, diamond, fullerenes, carbon nanotubes, aggregated diamond nanorods, glassy carbon, carbon nanofoam, lonsdaleite, and chaoite.

As used herein, "ceramic" refers to a hard, often crystalline, substantially heat and corrosion resistant material which may be made by firing a non-metallic material, sometimes with a metallic material. A number of oxide, nitride, and carbide materials considered to be ceramic are well known in the art, including without limitation, aluminum oxides, silicon oxides, boron nitrides, silicon nitrides, and silicon carbides, tungsten carbides, etc.

As used herein, "nano-abrasive" and "nano-particle" may be used interchangeably, and refer to abrasive particles having a size in the nano-range. Size ranges may vary depending on the particular use. In one aspect, however, nano-abrasives may range in size from about 1000 nm to about 1 nm. In another aspect, nano-abrasives may range in size from about 100 nm to about 10 nm. In yet another aspect, nano-abrasives may range in size from about 50 nm to about 20 nm. Such nano-particles may take a variety of shapes, including round, oblong, square, euhedral, etc., and they may be single crystal or polycrystalline.

As used herein, "working surface" refers to a surface of a polishing tool upon which asperities are formed for polishing applications.

As used herein, "impregnate" and "impregnated" refers to a first material having a second material introduced into it, or the act of introducing such. For example, "nano-diamond impregnated" indicates a material having nano-diamond admixed therein. In some aspects, the nanodiamond may occupy pores or spaces within the impregnated material. By way of example without limitation, a material may become impregnated with nano-diamond particles by providing such a material, for example a substrate material as a powder. The substrate powder material is then mixed with nano-diamond particles and melted to form a mixture. The mixture can then be further processed to a solid substrate containing nano-diamond particles. The product of such process is considered to be nano-diamond impregnated. Furthermore, a nano-diamond impregnated substrate may have nano-diamond dispersed evenly throughout the substrate, or may be unevenly dispersed. The nano-diamond may be present throughout the entire substrate, but randomly dispersed. Additionally, the nano-diamond may be present only in the working surface of the substrate. Furthermore, the nano-diamond may have higher concentration towards the working surface of the substrate.

As used herein, "height to distance ratio" in reference to asperities on a working surface refers to the ratio of the average asperity height to the average distance between asperities. The asperity height is measured from the working surface. The distance between asperities is measured from the intersection of the base of the asperity with the working surface to a nearest likewise location on a neighboring asperity. In essence, the distance measurement is the distance of uninterrupted flat (i.e. no asperities) working surface between asperities.

As used herein, "asperity diameter" refers to the measurement of an asperity from the location where the base of the asperity intersects the working surface, directly through the center of the asperity, along the plane of the working surface, and to a location where the base of the asperity intersects the working surface.

As used herein, "average" refers to any mathematical measurement of central tendency. Average includes the arithmetic mean, median or mode. With such small measurements of the present invention, it is understood that averages may not be calculated with precise measurements accounting for each asperity, but may be scientifically estimated as per practices common in the field.

As used herein, "truing" is refers to leveling a surface. The specific tolerances indicated by "truing" depend on the particular material and usage. In the present invention, any leveling or straightening of the working surface that allows for the formed asperities as claimed is to be included. In some embodiments, and under some circumstances, truing may include leveling a working surface to a surface roughness RA value of less than or equal to about 50 μm. In other embodiments, the surface roughness RA value may be less than or equal to about 20 μm. In still other embodiments, the surface roughness RA value may be less than or equal to about 10 μm.

Likewise, the term "pre-trued" refers to a level surface. Specific tolerances indicated by the term again depend on the particular material and usage. In the present invention, a level or straight surface that allows for the formation of the claimed asperities is to be included. In some embodiments, and under some circumstances, a pre-trued working surface may have a surface roughness RA value of less than or equal to about 50 μm. In other embodiments, the surface roughness RA value may be less than or equal to about 20 μm. In still other embodiments, the surface roughness RA value may be less than or equal to about 10 μm.

As used herein, "degree of graphitization" refers to the proportion of graphite that has graphene planes having a theoretical spacing of 3.354 angstroms. Thus, a degree of graphitization of 1 indicates that 100% of the graphite has a basal plane separation ($d_{(0002)}$) of graphene planes, i.e. with hexagonal network of carbon atoms, of 3.354 angstroms. A higher degree of graphitization indicates smaller spacing of graphene planes. The degree of graphitization, G, can be calculated using Equation 1.

$$G=(3.440-d_{(0002)})/(3.440-3.354) \quad (1)$$

Conversely, $d_{(0002)}$ can be calculated based on G using Equation 2.

$$d_{(0002)}=3.354+0.086(1-G) \quad (2)$$

Referring to Equation 1, 3.440 angstroms is the spacing of basal planes for amorphous carbon ($L_c$=50 Å), while 3.354 angstroms is the spacing of pure graphite ($L_c$=1000 Å) that may be achievable by sintering graphitizable carbon at 3000° C. for extended periods of time, e.g., 12 hours. A higher degree of graphitization corresponds to larger crystallite sizes, which are characterized by the size of the basal planes ($L_a$) and size of stacking layers ($L_c$). Note that the size parameters are inversely related to the spacing of basal planes. A "high degree of graphitization" can depend on the materials used, but typically indicates a degree of graphitization greater than about 0.8. In some embodiments, a high degree of graphitization can indicate a degree of graphitization greater than about 0.85.

Graphite is available in a wide variety of grades and forms such as amorphous, crystalline, and synthetic graphite. Table 1 shows crystallite properties for several common grades of graphite.

TABLE 1

| Graphite Type | $d_{(002)}$ | $L_a$ (Å) | $L_c$ (Å) | $I_{112}/I_{110}$ |
|---|---|---|---|---|
| Pure Natural | 3.355 | 1250 | 375 | 1.3 |
| Low Temp (2800° C.) | 3.359 | 645 | 227 | 1.0 |
| Electrode | 3.360 | 509 | 184 | 1.0 |
| Spectroscopic | 3.362 | 475 | 145 | 0.6 |
| High Temp (3000° C.) | 3.368 | | 400 | 0.9 |
| Low Ash | 3.380 | 601 | 180 | 0.8 |
| Poor Natural | 3.43 | 98 | 44 | 0.5 |

Further, Table 2 illustrates the anisotropic properties of graphite.

TABLE 2

| Graphite anisotropy | Thermal Conductivity (W/mK) | Thermal Expansion (ppm/K) |
|---|---|---|
| // to basal planes | 1950 | 0.5 |
| ⊥ to basal planes | 5.7 | 27 |

As used herein, "substantially" refers to situations close to and including 100%. Substantially is used to indicate that, though 100% is desirable, a small deviation therefrom is acceptable. For example, substantially all asperities includes groups of all asperities and groups of all asperities minus a relatively small portion of asperities.

As used herein, the term "about" is used to provide flexibility to a numerical range endpoint by providing that a given value may be "a little above" or "a little below" the endpoint.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary.

Concentrations, amounts, and other numerical data may be expressed or presented herein in a range format. It is to be understood that such a range format is used merely for convenience and brevity and thus should be interpreted flexibly to include not only the numerical values explicitly recited as the limits of the range, but also to include all the individual numerical values or sub-ranges encompassed within that range as if each numerical value and sub-range is explicitly recited. As an illustration, a numerical range of "about 1 to about 5" should be interpreted to include not only the explicitly recited values of about 1 to about 5, but also include individual values and sub-ranges within the indicated range. Thus, included in this numerical range are individual values such as 2, 3, and 4 and sub-ranges such as from 1-3, from 2-4, and from 3-5, etc.

This same principle applies to ranges reciting only one numerical value. Furthermore, such an interpretation should apply regardless of the breadth of the range or the characteristics being described.

The Invention

The present invention relates to novel polishing tools and methods for polishing substrates. The inventor has discovered that the scratching of a work piece during polishing may be more of a result of asperity configuration than the hardness of the material from which the polishing tool has been constructed. Accordingly, polishing tools with asperity tips that have been very precisely leveled can be used to effectively polish a surface of a work piece down to the nanometer range even if the tool is made from a very hard material.

Figure 1:
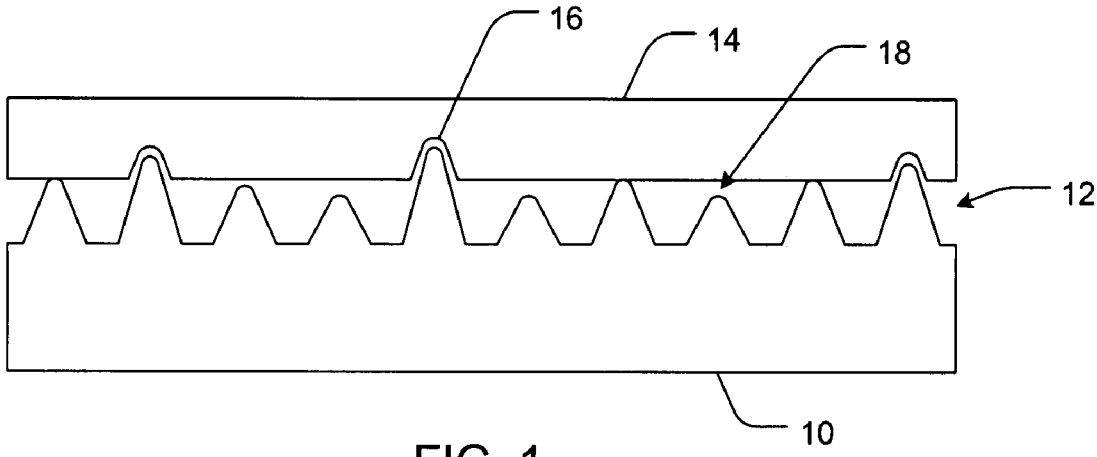
FIG. 1 is a cross-sectional view of a prior art polishing tool.

In the case of CMP polishing, for example, scratching of the wafer is often a result of the non-uniform asperities on the CMP pad. Turning to FIG. 1, for example, a polishing tool 10 is shown having asperities 12 with non-uniform heights. A work piece 14 is shown being polished by the polishing tool 10. Asperities having a greater protrusion from the mean asperity height tend to scratch (shown at 16) the work piece 14. Conversely, those asperities 12 having a lesser protrusion from the mean asperity height may not contact (shown at 18) the work piece 14 and are thus performing little or no work, and possibly even forming high spots on the work piece 14. These effects may occur with polishing tools made from soft as well as hard materials. In the case of soft materials, the scratches may be the result of increased pressure at the more highly protruding asperities.

Figure 2:
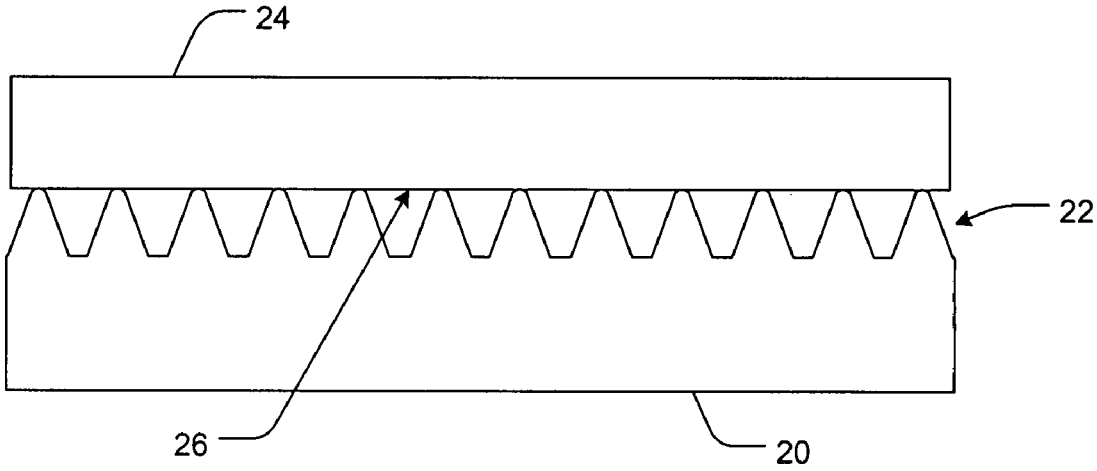
FIG. 2 is a cross-sectional view of a polishing tool in accordance with one embodiment of the present invention.

Accordingly, scratching can be minimized and polishing rates can be increased by precisely leveling the tips of the asperities, regardless of the hardness of the polishing tool. It is thus the variation in asperity configurations causing differential regions of pressure across the polishing surface of the work piece that facilitates scratching, rather than the relative level of hardness of the material from which the polishing tool is constructed. As is shown in FIG. 2, a polishing tool 20 having asperities of a substantially uniform height 22 will contact a work piece 24 evenly across a working surface 26. Such a polishing tool 20 will polish a work piece 24 evenly without the formation of significant scratches and high spots. Polishing rates will be increased with such a polishing tool because essentially all asperities are working to polish the tool, and no single asperity or group of asperities is exposed to a higher workload than any other asperity or group of asperities. Because polishing rate is proportional to pressure, the polishing tool may be constructed from a variety of materials, from hard materials to soft materials.

In one embodiment, a tool for polishing a work piece may include a solid substrate including greater than 10 wt % graphite having a high degree of graphitization, so that the substrate may carry an electrical bias. The solid substrate has improved properties when it has a working surface that has asperities with tip-to-tip RA value of less than or equal to about 10 μm. Also, the solid substrate demonstrates improved properties when it has a working surface that has a surface roughness RA value of less than or equal to about 50 μm.

Graphite having a high degree of graphitization is a soft, electrically conducting material. Further, graphite having a high degree of graphitization is inert and acid proof. Thus, such graphite is an excellent material for use in ECMP. This type of graphite is resilient to the chemicals that are used, and it is inert to the materials and conditions used in ECMP processing. Graphite having a lower degree of graphitization is too abrasive for some applications, and is typically not electrically conductive enough to be of use. Artificial graphite, for example, is made at temperatures less than 3000° C. As such, some carbon (e.g. 30%) is in an amorphous phase, which can be abrasive. On the other hand, graphite having a high degree of graphitization is very soft and electrically conducting and can therefore polish such delicate surfaces as copper. In one aspect, the degree of graphitization of the graphite can be greater than about 0.90. In a further aspect, the degree of graphitization of the graphite can be about 0.95.

In one aspect, the substrate can comprise or consist essentially of graphite having a high degree of graphitization. In another aspect, the substrate can consist essentially of graphite, with at least a portion of the graphite having a high degree of graphitization. Graphite, as noted, has very anisotropic properties. Therefore, the conductivity can be adjusted by randomly orienting the graphite planes, rather than aligning the graphite planes throughout the solid substrate.

Although the solid substrate having at least 10 wt % graphite having a high degree of graphitization make up the entire composition of the solid substrate, in some embodiments, other additives can be included. For example, a metal can be dispersed in the solid substrate. As one application of a solid substrate having highly graphitized graphite is the polishing of copper, the metal dispersed in the solid substrate can be one having a Moh's hardness less than that of copper. Solid substrates of highly-graphitized graphite impregnated with soft metal can be especially useful in polishing more delicate materials such as copper. The graphite having a high degree of graphitization can make up any amount of the solid substrate, such as, e.g., greater than 50 wt %, greater than 70 wt %, greater than 90 wt %, and greater than 95 wt %.

Another additive to the solid substrate can be interclating atoms. Atoms increase the conductivity of the graphite across the graphite planes. Fore example, foreign, e.g. non-carbon, atoms can intercalate graphite and make the graphite swell. As such, the foreign atoms are situated between the graphite planes. Any foreign atom that can increase the conductivity can be used, in particular nitrogen atoms, oxygen atoms, metal ions, and mixtures of atoms. A non-limiting example of interclating graphite is to boil graphite in nitric acid. By so doing, nitrogen and oxygen can intercalate graphene planes, thus making the graphite a much better conductor across plane, than the graphite without interclation. As mentioned, when graphite includes interclated atoms, it tends to swell. In such cases, the graphite planes can be spaced a greater distance apart and still be considered to be highly graphitized.

The solid substrate may include a carbon allotrope in addition to the highly-graphitized graphite. Carbon allotropes demonstrate a variety of material conductivities and may interact with other ECMP materials differently. As such, the selection of a carbon allotrope is dependent on a variety of factors, including cost, and such selection would be within the purview of one skilled in the art. Non-limiting examples of carbon allotropes that may be useful in the present invention include graphite (of any degree of graphitization), amorphous carbon, diamond, fullerenes, carbon nanotubes, aggregated diamond nanorods, glassy carbon, carbon nanoform, lonsdaleite, chaoite, and combinations thereof. Additionally, other forms of carbon may be useful in the present invention. Non-limiting examples include graphite powder, graphite flakes, graphite fibers, purified carbon of any form, carbon fibers, carbon powder, carbon black. The total composition of the solid substrate can, in one aspect, be carbon allotrope, including the graphite having a high-degree of graphitization. Likewise, the solid substrate can include various amounts of carbon allotrope such as greater than 95 wt %, greater than 90 wt %, greater than 80 wt %, etc.

In one embodiment, the substrate can include a conductive material including graphite having a high degree of graphitization, and optionally other conductive materials. Electrical conductivity in a composite structure, such as some of the present embodiments, is a function of the intrinsic conductivity of the single particle, and the particle-to-particle contact resistance. For ECMP applications, the electrical conductivity is limited by the lowest value rather than the average conductivity of the pad. Consequently, pads including graphite, particularly graphite having a high degree of graphitization, has a performance that can be more predictable than other like pads. Therefore, polishing can be better controlled, and thus unwanted polishing effects such as dishing can be minimized. The particle size of the graphite may also, in one aspect, be used to control pad conductivity. In cases utilizing a greater amount of graphite, the size of the graphite particles can affect the particle-to-particle resistance. Specifically, coarse particles reduce the particle-to-particle resistance and can improve graphite conductivity, as intra-particle resistance is lower. The particle size selection can be used to affect the conductivity of not only highly-graphitized graphite, but any graphite present in the substrate.

Graphite is an excellent conductor for use in ECMP pads as it can be dispersed more uniformly in materials such as polymer, due to the similar density and similar chemistry, as compared to other conductors, such as, e.g., tin. Additionally, as previously discussed, the use of finer grinds of any graphite type in the substrate can reduce the anisotropy of conduction. There are a variety of configurations for the placement of the conductive material. The conductive material may be present only in certain locations, specifically concentrated at certain points, uniformly spaced along various axes or throughout the solid substrate. The location and quantity of conductive material need only be such that it is sufficient to carry an electrical bias. Specific configurations would vary according to the materials used to manufacture the solid substrate, the material to be polished, projected parameters of use, etc., as would be apparent to one of ordinary skill in the art. The conductive material may be dispersed in the solid substrate in any manner sufficient to allow the substrate to carry an electrical bias. In one embodiment, the conductive material may be evenly dispersed throughout the substrate. The conductive material may also be concentrated towards the working surface. In one embodiment, the conductive material may be present on the working surface of the substrate. In a further embodiment, surface of the substrate may be a continuous layer of conductive material. In another variation, the conductive material may be uniformly spaced on the working surface. In yet another embodiment, the conductive material may be a continuous layer. The continuous layer may be present in the substrate at a depth below the surface and substantially parallel to the working surface. An embodiment of this configuration would allow for the solid substrate to carry a uniform bias. In a further embodiment, there may be multiple layers of conductive material in the solid substrate. These layers may be substantially parallel relative to one another.

Various polymers can be included in the solid substrate. The polymer need only be capable of inclusion in a solid substrate that includes graphite of a high degree of graphitization such that the substrate can carry an electrical bias. Additionally, the solid substrate must be capable of having a working surface including asperities which have a tip-to-tip RA value of less than or equal to 10 μm, and a surface roughness RA value of less than or equal to about 50 μm. Non-limiting examples of polymers that may be used include: polyurethane, polyamides, polyimides, nylon polymer, polyester, diene containing polymers, acrylic polymers, polyethylene, polypropylene, polystyrene, polyethylene terephthalate, polyamide, polyvinylchloride, polycarbonate, acrylonitrile butadiene styrene, polyvinyldiene chloride, polytetrafluoroethylene, polymethyl methacrylate, polyacetylene, ethylene-propylene-diene-methylene, and combinations thereof. In one embodiment, the polymer comprises polyurethane.

In one embodiment, the substrate comprises greater than about 70% by weight graphite. In embodiments that utilize graphite, Grafoil® or other types of flexible graphite may be used. The flexible graphite form may be sheet, ribbon, or braided. Additionally, the graphite may be sprayed onto the substrate, or portions of the substrate during manufacture.

The substrate may include additional additives, e.g., optional polymer additives, conductive elements such as metals and interclating atoms, and other additives. In one embodiment, the additional additive is present in less than about 25% by weight. Such additives could be included to modify the properties substrate. The additives could be included to alter the conductive or mechanical polishing properties of the solid substrate. Examples of additives which could be used include: diamond, boron carbide, cubic boron nitride, garnet, silica, ceria, alumina, zircon, zirconia, titania, manganese oxide, copper oxide, iron oxide, nickel oxide, silicon carbide, silicon nitride, tin oxide, titanium carbide, titanium nitride, tungsten carbide, yttria, Al, Cu, Zn, Ga, In, Sn, Ge, Pb, Tl, Cd, Ag, Au, Ni, Pd, Pt, Co, Fe, Mn, W, Mo, Cr, Ta, Nb, V, Sr, Ti, Si, and combinations thereof. More than one additive could be used, and their selection and inclusion would be within the purview of one of ordinary skill in the art.

The precise leveling of the asperities thus allows polishing tools to be constructed from more durable materials that have previously been allowed that can be resurfaced and reused to a much greater extent. Nano-diamond impregnated pads, for example, can be created by forming asperities along the working surface of the tool with a polycrystalline diamond dresser. Additionally, slurries containing abrasive particles are optional with the use of such a tool. The precisely aligned tips of the asperities abrasively polish the work piece in a polishing operation, although various abrasives, chemicals, reduction/oxidation reactions, etc may assist this process.

The polishing tools created through the disclosed methods may have multiple and various uses. It is intended that the scope of use of the tools created according to the disclosed methodologies not be limited to a particular work piece or polishing operation, but that such scope include any type of polishing or abrading for which these tools and techniques would be useful. Examples of work, pieces may include, without limitation, wafers, LEDs, laser diodes, mirrors, lenses, memory storage surfaces, integrated circuits or any other structures containing conductive and/or dielectric structures, quartz, glass, metals, semiconductors, etc. Additionally, the range of detail of polishing may vary depending on the material being polished and the desired application of such material.

In one aspect of the present invention, a method of polishing a work piece is provided. Such a method may include providing a polishing tool, as explained above, which have a solid substrate including at least 10 wt % graphite having a high degree of graphitization sufficient to allow the substrate to carry an electrical bias. The solid substrate may have asperities on a working surface, where the asperities have a tip-to-tip RA value of less than or equal to about 10 μm, and where the working surface has a surface roughness RA value of less than or equal to about 50 μm. The method may also include coupling the working surface to a power supply and establishing an electrically-conductive path from the working surface to an interface surface of the work piece. The method further includes electrochemically removing a portion of the interface surface of the work piece and moving the tips of the asperities in a direction substantially parallel to the interface surface of the work piece to polish the interface surface. Any two or more parts of the method may be performed substantially simultaneously or in overlapping times. In one embodiment, establishing an electrically conductive path and contacting the tips of the asperities against the interface surface of the work piece are performed substantially simultaneously. In another embodiment, establishing an electrically-conductive path and electrochemically removing a portion of the interface surface of the work piece may be performed substantially simultaneously. In still another embodiment, contacting the asperities against the interface surface of the work piece and electrochemically removing a portion of the interface surface of the work piece may be performed substantially simultaneously.

To aid in the processing, a liquid solution may be added to the solid substrate. The liquid solution may include an electrolyte. In an embodiment, the electrically-conductive path from the working surface to an interface surface of the work piece may be through the liquid solution. In a configuration, the solid substrate may be fully or partially submerged in a liquid solution. Non-limiting examples of electrolytes that may be used include sulfuric acid, phosphoric acid, amino acid, organic amine, phthalic acid, organic carbolic acid, picolinic acid, and combinations thereof.

The power supply coupled to the working surface of the substrate may be continuous. Alternatively, the power supply may be discontinuous. In one embodiment, the power supply may be pulsed, in that it is turned on and off in intervals. In yet another embodiment, the power supply may be continuously varied over time. In another embodiment, the power supply may be incrementally varied over time. By adjusting the power supply (in both presence and in power level), the polishing may be fine-tuned so as to get the best polish. In some instances, a polishing program may be developed to adjust the power supply over time so as to obtain the desired polish. Such adjustments may not only improve the polish quality, but may also decrease the time required for polishing. For example, a higher voltage may be used at first to remove larger amounts of material, and the voltage may be reduced over time to produce a potentially more even and fine polish.

Any method of making the polishing tools of the various aspects of the present invention is intended to be included within the scope of the present invention. In one aspect, for example, a method for making such a tool is provided that includes truing a working surface of a solid substrate to a surface roughness RA value of less than or equal to about 50 μm. The solid substrate may include greater than 10 wt % graphite having a high degree of graphitization, such that the solid substrate may carry an electrical bias. The method may also include forming asperities on the working surface, where the asperities have a tip-to-tip RA value of less than or equal to about 10 μm. In another embodiment, the method may include forming asperities on the working surface where the asperities have a height to distance ratio of from about 1:5 to about 5:1, and the average asperity diameter may be less than about 175 μm.

Various tools for polishing a work piece are also contemplated that may be made according to methods of the present invention. Any polishing tool having a surface configuration and asperities according to aspects disclosed herein would be considered to be within the present scope. Examples may include, without limitation, CMP pads, grinding disks, fixed abrasive pads, etc.

Because asperities may be significantly smaller than the average surface roughness of an un-trued working surface, it may be beneficial to true the working surface of the polishing tool prior to forming asperities thereon. Alternatively, it may be beneficial to obtain a pre-trued solid substrate as contemplated in the present invention. A pre-trued substrate would have a working surface that is trued to a surface roughness RA value of less than or equal to about 50 μm. A substrate may be pre-trued in a prior manufacturing process, or may be obtained in such a state. FIG. 3 shows a solid substrate 30 having a working surface 32 having a surface roughness RA value, shown at 34. In order to effectively polish a work piece, substantially all asperities along the working surface should contact the interface surface to be polished. High regions of increased surface roughness along the working surface will cause the asperities in that region to press more tightly against the interface surface, thus causing scratching as has been described. Depending on the extent of the surface roughness, asperities in low regions along the working surface may not contact the interface surface, thus further increasing scratching problems. Such non-uniform contact of asperities against the interface surface of the work piece also results in lower polishing rates. As a result, a precisely trued working surface of the polishing tool will reduce the frequency and scale of scratching.

Various methods and tools are contemplated for truing the working surface of the solid substrate. Nearly any method of truing the working surface can be used as long as it is capable of creating a surface roughness RA value within the tolerances disclosed herein. The tolerances for the surface roughness RA values may vary depending on the intended application and the relative scale of polishing for a given polishing tool. It should be noted that the range of acceptable surface roughness RA values is also necessarily dependent on the intended tolerances for the tip-to-tip RA values of the asperities being formed thereon. As such, the working surface may be trued to a surface roughness RA value that allows the asperities formed thereon to obtain an acceptable range of tip-to-tip RA values such that the polishing tool may be used to polish the work piece to a desired finish. It would thus be within the ability of one of ordinary skill in the art once in possession of the present disclosure to design a polishing tool having a surface roughness RA that is compatible with a desired level of polishing.

In one aspect of the present invention, the working surface may be trued by shaving with a planing tool. The nature and configuration of such a planing tool may depend to some extent on the nature of the work piece and the desired level of polishing. In one specific aspect, however, the planing tool may be a polycrystalline diamond (PCD) planer. The extreme hardness of PCD makes it a good material from which to form a planing tool, particularly with nano-diamond impregnated substrates. Additionally, PCD can be manipulated to form various cutting shapes and configurations. Accordingly, a PCD planer may be constructed by sintering a PCD material such as PCD powder at ultrahigh pressures and high temperatures. The resulting PCD matrix can be carved to a desired planar configuration by any useful method, such as plasma etching, laser ablation, electro discharge machining (EDM), or any other method known to one of ordinary skill in the art. Further details relating to the use of such PCD materials in the construction of planers and other PCD tools, as well as examples of specific tools can be found in U.S. patent application Ser. No. 11/357,713, filed on Feb. 17, 2006, which is incorporated herein by reference.

Though various levels of surface roughness are contemplated depending on the intended application of the polishing tool, in one aspect the surface roughness RA value may be less than or equal to about 50 μm. In another aspect, the surface roughness RA value may be less than or equal to about 20 μm. In yet another aspect, the surface roughness RA value may be less than or equal to about 10 μm.

As has been discussed, precisely leveled asperity tips will improve the polishing characteristics of the polishing tool, and reduce the tip-to-tip RA value of the asperities across the working surface. The lower the tip-to-tip RA value, the finer the polished resolution of the resulting polished surface. As such, it may be beneficial for some applications to CMP process the working surface of the polishing tool prior to forming the asperities thereon. Such CMP processing may result in a finer resolution of polishing than what can be afforded by truing the surface alone.

Once the surface has been trued and optionally CMP processed, the asperities may be formed thereon by any means known to one of ordinary skill in the art, provided that the resulting asperities are leveled to the tip-to-tip RA values as disclosed herein. FIG. 4 shows a polishing tool 40 having asperities 42 formed thereon, and having a tip-to-tip RA value, shown at 44. In addition to asperity leveling, density and patterning of asperities across the working surface may also affect the polishing characteristics of the tool. The polishing rate of a tool may vary in relation to asperity density. On one hand, as asperity density increases, the number of asperities contacting the work piece increases. On the other hand, the pressure exerted by each asperity decreases as the asperity density increases up to a point due to the total force exerted by the polishing tool being divided up across all working asperities. Because polishing rate is related to the area of contact and the exerted pressure between the tool and the work piece, the density of the formed asperities may be adjusted to provide an optimal polishing rate. Accordingly, in one aspect of the present invention, the asperities may be formed on the working surface according to a predetermined pattern.

Various methods are contemplated for forming asperities on the working surface of the solid substrate. Accordingly, any method of forming asperities conforming to tip-to-tip RA values as disclosed herein is considered to be within the scope of the present invention. The tolerances for such RA values may vary somewhat depending on the intended application and the relative scale of polishing for a given polishing tool, the materials of manufacture of the substrate, and the anticipated conditions of use of the substrate. Additionally, some limits may be placed on the tip-to-tip RA values by the level of truing of the working surface prior to asperity formation.

In one aspect of the present invention, the asperities may be formed by dressing the working surface with a dressing tool. Dressing tools are well known in the art. However, as has been discussed, current dressing tools are unable to form asperities in a tool surface having tip-to-tip RA values as disclosed herein. As such, dressers having precisely leveled cutting elements are required for forming such asperities. In one specific aspect, such a dressing tool may be a PCD dresser. As has been discussed, the extreme hardness of PCD makes it a good material from which to form a dressing tool. Additionally, PCD can be manipulated to form various cutting elements and cutting element configurations. Accordingly, a PCD dresser may be constructed by sintering a PCD material such as PCD powder at ultrahigh pressures and high temperatures. The resulting PCD matrix can be carved to a desired dresser configuration, including individual cutting elements having very precise projections and orientations. As with the PCD planer, the PCD dresser may be shaped and carved by any useful method, such as plasma etching, laser ablation, electro discharge machining (EDM), or any other method known to one of ordinary skill in the art. Further details relating to the use of PCD materials in the construction of dressers and other PCD tools can also be found in the aforementioned U.S. patent application Ser. No. 11/357,713.

In addition to PCD dressers, other tools having very precisely leveled cutting elements may be utilized to form asperities in the polishing tools of the present invention. For example, superabrasive particles generally cannot be leveled precisely when incorporated into a brazed metal tool due to the movement of the thermal movement of the tool during cooling. Superabrasive particles may, however, be incorporated into tools that utilize a resin or other organic layer as a particle substrate. Examples of such tools may be found in U.S. patent application Ser. No. 11/026,544 filed on Dec. 30, 2004, and Ser. No. 11/223,786 filed on Sep. 9, 2005, both of which are incorporated herein by reference.

Although various resolutions of polishing are contemplated depending on the intended application of the polishing tool, in one aspect the tip-to-tip RA value may be less than or equal to about 10 μm. In another aspect, the tip-to-tip RA value may be less than or equal to about 5 μm. In yet another aspect, the tip-to-tip RA value may be less than or equal to about 1 μm. In a further aspect, the tip-to-tip RA value may be less than or equal to about 0.8 μm.

Various materials are contemplated from which the polishing tools of the present invention may be made. Because the asperities are precisely leveled and substantially all come into contact with the interface surface of the work piece, scratching can be avoided regardless of the hardness of the polishing pad. As such, virtually any material upon which asperities can be formed within the RA tolerances provided herein can be utilized to form such polishing tools. Specific polishing tool materials can be chosen by one of ordinary skill in the art depending on the particular application of the tool. For example, as nano-diamond is to be incorporated into the tool, it may be helpful to utilize materials that will readily wet diamond in order to improve retention. Furthermore, if an acid slurry is to be used to assist polishing, it may be useful to select a material that provides resistance to the particular acids included in the slurry. Additionally, the oxide potentials of various materials may also influence which materials are utilized, particularly in those applications involving electrolytic polishing.

Various organic and inorganic materials are contemplated which can be used to construct polishing tools. In certain aspects, however, the polishing tool may be constructed from inorganic materials and thus may be an inorganic polishing tool. In one aspect, the polishing tool may contain various proportions of metal within the solid substrate. For example, in one aspect, the polishing tool may be comprised of at least about 50% metal. In another aspect, the polishing tool may be comprised of at least about 75% metal. In yet another aspect, the polishing tool may be comprised of at least about 95% metal.

As has been discussed, any material capable of having asperities formed thereon within the tolerances specified herein and, in one aspect, being impregnated with nano-diamond is considered to be within the present scope. In particular, and without limitation, the polishing tool may include conductive materials or various additives such as Al, Cu, Zn, Ga, In, Sn, Ge, Pb, Tl, Cd, Ag, Au, Ni, Pd, Pt, Co, Fe, Mn, W, Mo, Cr, Ta, Nb, V, Sr, Ti, Si, and mixtures thereof, including composite materials, polymers, and ceramics.

In one aspect of the present invention the polishing tool may be include a conductive material or an additive from a metal having a melting point of less than about 700° C. Such soft metal additives may provide various manufacturing benefits. For example, softer metals are more easily manipulated due to their increased malleability. They may aid in formation of asperities, particularly for those aspects involving cutting the asperities with a dresser. A few non-limiting exemplary soft metals are shown in Table 3, along with their melting temperatures.

TABLE 3

| Soft Metal | Melting Point (° C.) |
|---|---|
| Al | 660.5° |
| Sb | 630.8° |
| Zn | 420.0° |
| Pb | 327.5° |
| Cd | 325.1° |
| Tl | 304.0° |
| Bi | 271.4° |
| Sn | 232.0° |
| In | 156.6° |
| Ga | 29.8° |

In those aspects where lower melting point metals are to be used in the construction of polishing tools, various alloys may also be utilized. Alloying at least two metals or a metal with a non-metal generally decreases the melting point of the alloy. Such alloys may be binary, ternary, or other multi-component alloys. A few non-limiting examples of such alloys are shown in Table 4. The wt % is provided in Table II for the first named element in the metal alloy.

TABLE 4

| Metal Alloy | Wt % | Melting Point (° C.) |
|---|---|---|
| Al—Si | 12.6 | 577° |
| Babbitt Alloy | — | 480° |
| Cu—Mg | 60 | 457° |
| Al—Cu | 32 | 548.2° |
| Al—Mg | 15-90 | 437-450° |
| Cu—Zn | 99.3 | 425° |
| Al—Ge | 51.6 | 420.0° |
| Cu—Sn | 99.3 | 227° |
| Al—Sn | 99.4 | 220° |
| Sn—Zn | 91.2 | 198.5° |
| Sn—Tl | 43 | 168° |

One example of a useful metal may include Al, which has a high oxide potential and readily wets diamond. Accordingly, the polishing tool may be substantially solid aluminum, or it may be an alloy thereof. For example, useful alloys may include, without limitation, Al—Si, SiC, and solder alloys such as Sn—Cu—Ag.

An additional benefit of utilizing metal in the manufacture of polishing tools is the capability to introduce an electrical bias in the tool to facilitate polishing by electrolytic reactions. So called electrical CMP (ECMP) polishing can assist in the elimination of high spots of certain metallic materials from a work piece. The oxidation product can then be mechanically wiped from the interface surface. In one aspect, an electrical bias is introduced across the metal polishing tool which causes oxidation of materials contacted by the metal pad. Due to this contact-specific oxidation, only the high points of the metallic material on the work piece is oxidized. This process may be particularly useful for polishing copper traces or other conductive structures.

In another aspect of the present invention, the polishing tool may be an organic polishing tool. Examples of organic materials useful in the construction of such polishing tools may include various polymeric materials. Such materials may include, without limitation, urethanes, carbonates, amides, sulfones, vinyl chlorides, acrylates, methacrylates, vinyl alcohols, esters, acrylamide moieties, or combinations thereof. In one aspect, the nano-diamond is impregnated in a polymeric material. In a further embodiment, the nano-diamond is dispersed in Polytetrafluoroethylene (PTFE), generally known as Teflon®. Further discussion of organic polishing tools can be found in U.S. Pat. No. 6,022,268, which is hereby incorporated by reference.

The polishing tools according to various aspects of the present invention can be used for polishing applications with or without abrasive particles. As such, in one aspect a work piece may be polished in the absence of abrasive particles. In these cases, mechanical polishing occurs due to the movement of the tips of the asperities across the surface being polished. Such abrasive-free polishing may be assisted by chemical slurries, electrolytic reactions, etc. In another aspect, however, nano-abrasive particles may be included to increase the rate of the polishing of the work piece. Such nano-abrasive particles may be included into the polishing tool itself, or it may be externally applied prior to or during the polishing operation. In one specific aspect, for example, a slurry having nano-abrasive particles may be applied to the working surface of the polishing tool or to the interface surface of the work piece. In one embodiment, a nano-abrasive slurry and an electrolytic solution may be used together. In another aspect, nano-abrasive particles may be disposed within at least a portion of the working surface of the polishing tool as an impregnated composite material. These particles may be mixed with or otherwise included in the material used to construct the polishing tool during manufacture. In order to disperse the nano-abrasive particles uniformly within the matrix material, abrasive particles may be pre-coated with a coupling agent that is wetable by the matrix material. Thus the nano-abrasive particles would be located at the tips of the asperities, and thus may increase the polishing action of the tool. As the tool wears, further nano-abrasive particles may be exposed, thus further assisting the polishing operation. In yet another embodiment, the nano-abrasive particles may be affixed to the working surface of the polishing tool prior to or following the formation of the asperities. In one embodiment, such nano-abrasive particles can be included in a substrate having a greater than about 10 wt % graphite having a high degree of graphitization. In some aspects, the amount may be greater than about 20 wt %. In yet another aspect, the amount may be greater than about 40 wt %. In yet another aspect, the amount may be greater than about 60 wt %. In some aspects, the amount may be from about 5 wt % to about 90 wt %.

In this manner, and other like variations, oxidation of metals such as copper can occur simultaneous to polishing of the same or other materials, such as, e.g., silicon. At the very least, both procedures may be performed using the same polishing pad, even though they may not be performed at the same time, but at different times.

Although any nano-abrasive particle capable of assisting in the polishing of a work piece would be considered to be within the scope of the claims of the present invention, specific examples may include, or consist of, diamond, boron carbide, cubic boron nitride, garnet, silica, ceria, alumina, zircon, zirconia, titania, manganese oxide, copper oxide, iron oxide, nickel oxide, silicon carbide, silicon nitride, tin oxide, titanium carbide, titanium nitride, tungsten carbide, yttria, and mixtures thereof. Additionally, various other ceramic material may be utilized as nanoabrasive particles. In one specific aspect, the nano-abrasive particles may include or consist of nano-diamond particles. Additionally, although nano-abrasive particles have been primarily discussed in relation to the polishing tools of the various aspects disclosed herein, it should be understood that for particular applications micron-sized abrasive particles may be used, and should be included within the present scope.

Regarding truing the working surface of a substrate, the present invention is meant to include taking a pre-trued substrate and forming asperities thereon. A tool having a trued surface may be purchased in the trued state, or may be obtained through other means. Therefore, any means of truing a surface of a nano-diamond impregnated substrate is to be included in the present invention.

Of course, it is to be understood that the above-described arrangements are only illustrative of the application of the principles of the present invention. Numerous modifications and alternative arrangements may be devised by those skilled in the art without departing from the spirit and scope of the present invention and the appended claims are intended to cover such modifications and arrangements. Thus, while the present invention has been described above with particularity and detail in connection with what is presently deemed to be the most practical and preferred embodiments of the invention, it will be apparent to those of ordinary skill in the art that numerous modifications, including, but not limited to, variations in size, materials, shape, form, function and manner of operation, assembly and use may be made without departing from the principles and concepts set forth herein.

What is claimed is:

1. A tool for polishing a work piece, comprising:

a solid substrate including greater than 10 wt % graphite having a high degree of graphitization, and including interclating atoms, said substrate configured to carry an electrical bias, the solid substrate having a working surface including asperities having a tip-to-tip RA value of less than or equal to about 10 μm, and said working surface having a surface roughness RA value of less than or equal to about 50 μm.

2. The tool of claim 1, wherein the degree of graphitization of the graphite is greater than about 0.90.

3. The tool of claim 2, wherein the degree of graphitization of the graphite is greater than about 0.95.

4. The tool of claim 1, wherein the graphite having a high degree of graphitization has a random orientation in the solid substrate.

5. The tool of claim 1, wherein the substrate includes a metal dispersed therein.

6. The tool of claim 5, wherein the metal is a member selected from the group consisting of In, Ag, Cu, Pb, Zn, Sn, Au, and alloys thereof.

7. The tool of claim 5, wherein the metal is a soft metal having a Moh's hardness of less than that of copper.

8. The tool of claim 1, wherein the graphite having a high degree of graphitization comprises greater than about 50 wt% of the solid substrate.

9. The tool of claim 8, wherein the graphite having a high degree of graphitization comprises greater than about 70 wt% of the solid substrate.

10. The tool of claim 1, wherein the interclating atoms are selected from nitrogen, oxygen, metal ions, and mixtures thereof.

11. The tool of claim 1, wherein the solid substrate further comprises a second carbon allotrope, said second allotrope not including graphite having a high degree of graphitization.

12. The tool of claim 11, wherein the second carbon allotrope comprises a member selected from the group consisting of graphite not having a high degree of graphitization, amorphous carbon, diamond, fullerenes, carbon nanotubes, aggregated diamond nanorods, glassy carbon, carbon nanofoam, lonsdaleite, chaoite, and combinations thereof.

13. The tool of claim 1, wherein the substrate comprises greater than about 90% carbon allotrope including the graphite having a high degree of graphitization.

14. The tool of claim 1, wherein the tip-to-tip RA value is less than or equal to about 5 μm.

15. The tool of claim 1, wherein the surface roughness RA value is less than or equal to about 20 μm.

16. The tool of claim 1, wherein the substrate includes nano-abrasive particles.

17. The tool of claim 16, wherein the nano-abrasive particles are selected from the group consisting of diamond, boron carbide, cubic boron nitride, garnet, silica, ceria, alumina, zircon, zirconia, titania, manganese oxide, copper oxide, iron oxide, nickel oxide, silicon carbide, silicon nitride, tin oxide, titanium carbide, titanium nitride, tungsten carbide, yttria, and mixtures thereof.

* * * * *